US007547227B1

(12) United States Patent
Gibson et al.

(10) Patent No.: US 7,547,227 B1
(45) Date of Patent: Jun. 16, 2009

(54) ADHESIVE LAMINATE LABEL FOR A COMMUNICATION CONNECTOR JACK AND COMMUNICATION CONNECTOR JACK INCLUDING SAME

(75) Inventors: Adam Gibson, Lynnwood, WA (US); Keith Kosanovich, Mill Creek, WA (US); Max Banakar, Bellevue, WA (US)

(73) Assignee: Leviton Manufacturing Co., Inc., Little Neck, NY (US)

( * ) Notice: Subject to any disclaimer, the term of this patent is extended or adjusted under 35 U.S.C. 154(b) by 0 days.

(21) Appl. No.: 12/148,709

(22) Filed: Apr. 21, 2008

(51) Int. Cl.
*H01R 3/00* (2006.01)

(52) U.S. Cl. ..... 439/491

(58) Field of Classification Search ..... 439/488, 439/491; 40/5; 361/824, 825, 826; 385/134
See application file for complete search history.

(56) References Cited

U.S. PATENT DOCUMENTS 2,431,999 A * 12/1947 Engelhardt ..... 439/718
4,820,193 A 4/1989 Noorily
5,051,870 A 9/1991 Companion
5,538,438 A 7/1996 Orlando
5,613,874 A 3/1997 Orlando et al.
6,017,229 A 1/2000 Tulley et al.
6,215,067 B1 * 4/2001 Chen ..... 174/66
6,305,950 B1 10/2001 Doorhy
6,337,836 B1 1/2002 Eidelson
6,371,793 B1 4/2002 Doorhy et al.
6,416,339 B1 7/2002 Snow et al.
6,461,189 B1 * 10/2002 Koh ..... 439/491
6,478,611 B1 11/2002 Hyland
6,496,884 B1 * 12/2002 Friesen ..... 710/100
6,786,776 B2 9/2004 Itano et al.
6,814,624 B2 11/2004 Clark et al.
6,974,352 B2 12/2005 Clark et al.
7,270,565 B2 9/2007 Kamata et al.
7,306,492 B2 12/2007 Clark et al.
2002/0194725 A1 12/2002 Perea, Jr. et al.
2004/0163837 A1 8/2004 Price
2006/0084323 A1 4/2006 Clark et al.
2007/0238352 A1 10/2007 Deng

* cited by examiner

*Primary Examiner*—Neil Abrams
(74) *Attorney, Agent, or Firm*—Kathryn J. Milam; Paul F. Rusyn; Graybeal Jackson LLP

(57) ABSTRACT

An embodiment of the invention is directed to an adhesive laminate label for use on a communication connector jack. The adhesive laminate label includes an upper label including a first termination diagram. The adhesive laminate label includes a lower label having a second termination diagram that is different than that of the first termination diagram. At least the second termination diagram of the lower label is covered by the upper label, and the lower label is removably adhered to the upper label. Other embodiments are directed to a communication connector jack including such an adhesive laminate label, and a method of terminating signal lines at signal-line terminals of a communication connector jack.

25 Claims, 8 Drawing Sheets

ADHESIVE LAMINATE LABEL FOR A COMMUNICATION CONNECTOR JACK AND COMMUNICATION CONNECTOR JACK INCLUDING SAME

BACKGROUND

A modular communication connector jack is a receptacle that accepts a communication plug. Common communication connector jacks include Category 5, 5e, 6, 6a, or 10G electrical connector jacks that are configured to accept a communication plug, such as a voice/data/video plug. For example, such communication connector jacks may be configured to accept a communication plug from a communication cable, such as an Ethernet cable. Typically, such communication connector jacks are used to electrically interconnect telecommunication equipment.

Communication connector jacks of this type typically include an electrically insulating housing that supports a plurality of electrical terminals at which electrical conductors of a multi-conductor cable are terminated. For example, many commercially available communication connector jacks employ insulation displacement contacts, and each electrical conductor may be terminated at one of the insulation displacement contacts using a specially designed termination tool.

For proper functioning of a communication connector jack, it is important that each conductor of the multi-conductor cable is correctly paired, sequenced, and terminated at a correct one of the electrical terminals of the communication connector jack. Incorrect termination and subsequent connection to telecommunications equipment can impede the functioning of and can cause damage to such telecommunications equipment. Furthermore, incorrect termination of the multi-conductor cable can cause costly and timely troubleshooting.

SUMMARY

An embodiment of the invention is directed to an adhesive laminate label for use on a communication connector jack. The adhesive laminate label includes an upper label having a first termination diagram. The adhesive laminate label further includes a lower label having a second termination diagram that is different than that of the first termination diagram. At least the second termination diagram of the lower label is covered by the upper label, and the upper label is removably adhered to the lower label.

Another embodiment of the invention is directed to a communication connector jack that includes an adhesive laminate label positioned thereon. The communication connector jack includes a connector body having a recess configured to receive a communication plug. A plurality of signal-line terminals may be associated with the connector body. The adhesive laminate label includes an upper label having a first termination diagram for terminating signal lines at the plurality of signal-line terminals. The adhesive laminate label further includes a lower label having a second termination diagram for terminating the signal-lines at the plurality of signal-line terminals that is different than that of the first termination diagram. At least the second termination diagram of the lower label is covered by the upper label, and the upper label is removably adhered to the lower label.

DETAILED DESCRIPTION

Embodiments of the invention relate to an adhesive laminate label that includes an upper label having a first termination diagram (e.g., a T568B termination diagram) that covers a second termination diagram (e.g., a T568A termination diagram) of a lower label, and a modular communication connector jack including such an adhesive laminate label. The disclosed adhesive laminate label embodiments enable an installer to select which one of the upper and lower labels is visible to provide a visual aid so that the installer can correctly terminate signal lines (e.g., electrical conductors of a multi-conductor cable or optical fibers) at signal-line terminals of a modular communication connector jack in accordance with a termination diagram on the selected one of the upper and lower labels in view.

Figure 1:
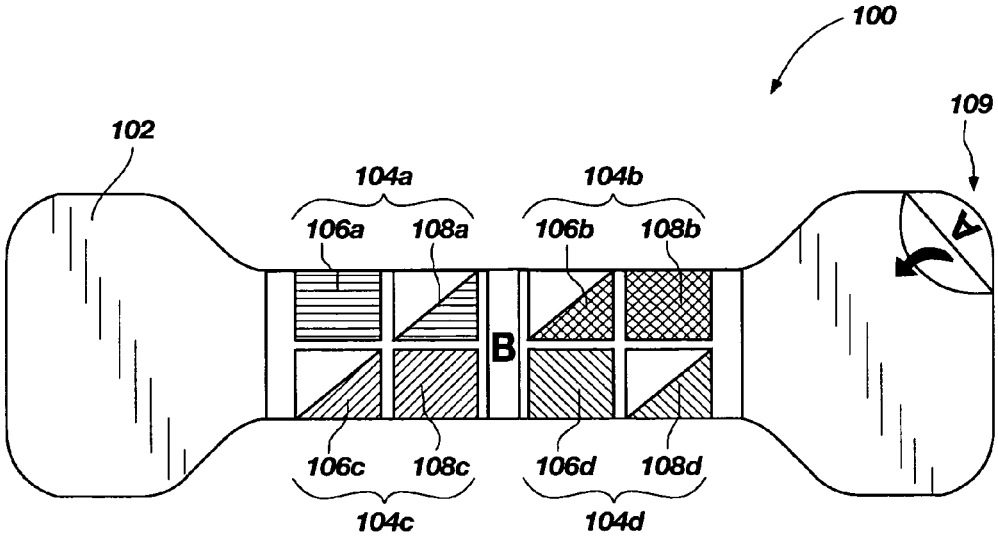
FIG. 1 is a top plan view of an adhesive laminate label, according to one embodiment of the invention, including an upper label having a first termination diagram.

FIG. 1 is a top plan view of an adhesive laminate label 100 according to one embodiment of the invention. The adhesive laminate label 100 includes an upper label 102 having a first plurality of color-coded symbol pairs 104*a*-104*d* arranged to represent a first termination diagram for terminating signal lines of a multi-signal-line cable at signal-line terminals of a modular communication connector jack. For example, in the illustrated embodiment, the first termination diagram is in accordance with the T568B wiring standard and a symbol (e.g., the letter "B" in the illustrated embodiment) may be provided on the upper label 102 to represent that the first termination diagram is in accordance with the T568B wiring standard. It should be noted that the use of the T568B wiring standard is merely one example for the first termination diagram and other termination diagrams are contemplated.

Still referring to FIG. 1, each symbol pair 104*a*-104*d* includes a corresponding color-coded symbol 106*a*-106*d* and a corresponding color-coded symbol 108*a*-108*d*. The type of cross-hatching or lack thereof used to represent each color-coded symbol 106*a*-106*d* and 108*a*-108*d* represents the color. For example, in the T568B wiring standard, the color-coded symbols 106*a*-106*d* may be blue, white/orange, white/brown, and green, respectively, and the color-coded symbols 108*a*-108*d* may be white/blue, orange, brown, and white/green, respectively. As will be discussed in more detail with respect to FIGS. 4-11, each color-coded symbol pair 104*a*-104*d* may be color coded to correspond with a pair of signal lines of a multi-signal-line cable, such as a pair of electrical conductors of a multi-conductor cable to be terminated at a modular communication connector jack to which the adhesive laminate label 100 is adhered.

Figure 2:
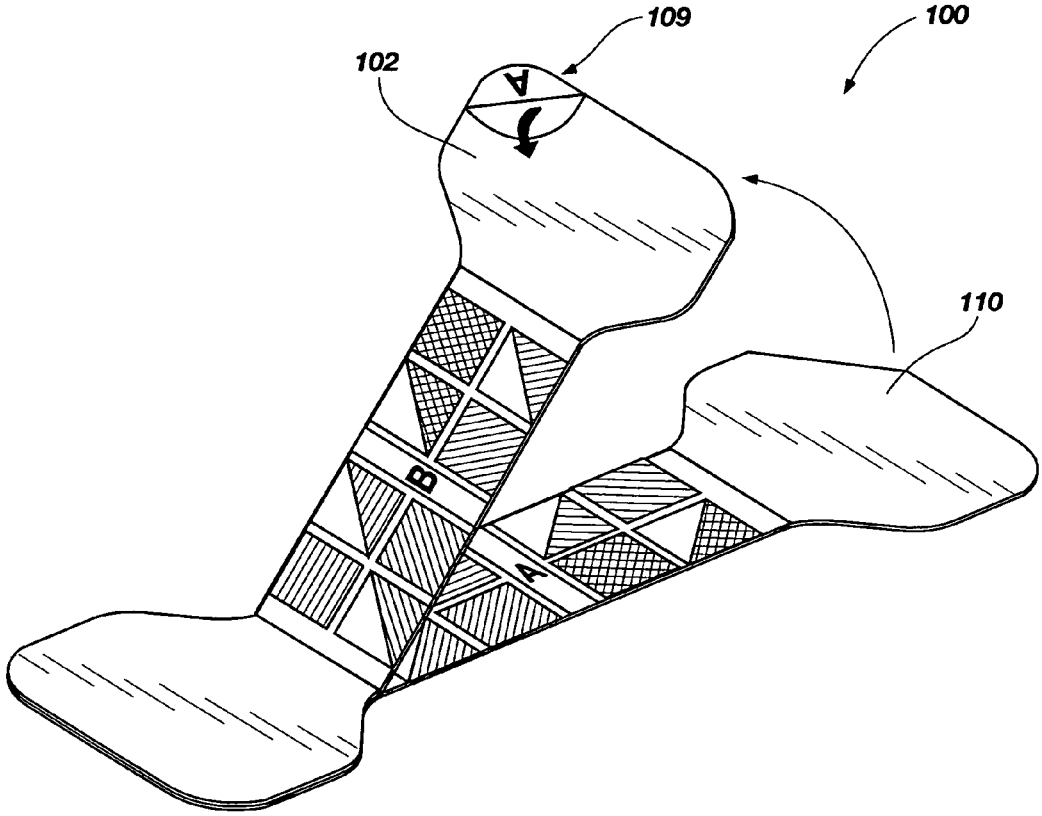
FIG. 2 is an isometric view of the adhesive laminate label shown in FIG. 1 illustrating the upper label being removed from an underlying lower label.

Referring to the isometric view of the adhesive laminate label 100 shown in FIG. 2, the adhesive laminate label 100 includes at least one underlying lower label 110 that is at least partially covered by the upper label 102. For example, the upper label 102 may be removably adhered to the lower label 110. The upper label 102 and lower label 110 may each be formed from a number of well-known polymeric materials. Further, a back side of the upper label 102 may include a pressure-sensitive adhesive or an adhesive backing for adhering it to the underlying lower label 110, and a back side of the lower label 110 may employ the same or similar adhesives or adhesive backing for adhering it to a connector body of a modular communication connector jack.

Still referring to FIG. 2, the upper label 102 may be manually peeled off of the lower label 110. A marking 109 positioned on the upper label 102, such as a corner thereof, may indicate the presence of a second termination diagram on the underlying lower label 110. For example, in the illustrated embodiment, the marking 109 is a letter "A" that indicates that the second termination diagram on the lower label 110 is in accordance with the T568A wiring standard. However, any other suitable marking may be used.

It is also noted that although the adhesive laminate label 100 is illustrated as including only one lower label 110, in other embodiments of the invention, the adhesive laminate label 100 may include two or more lower labels each of which may have a different respective termination diagram thereon that is different than that of the first termination diagram on the upper label 102.

Figure 3:
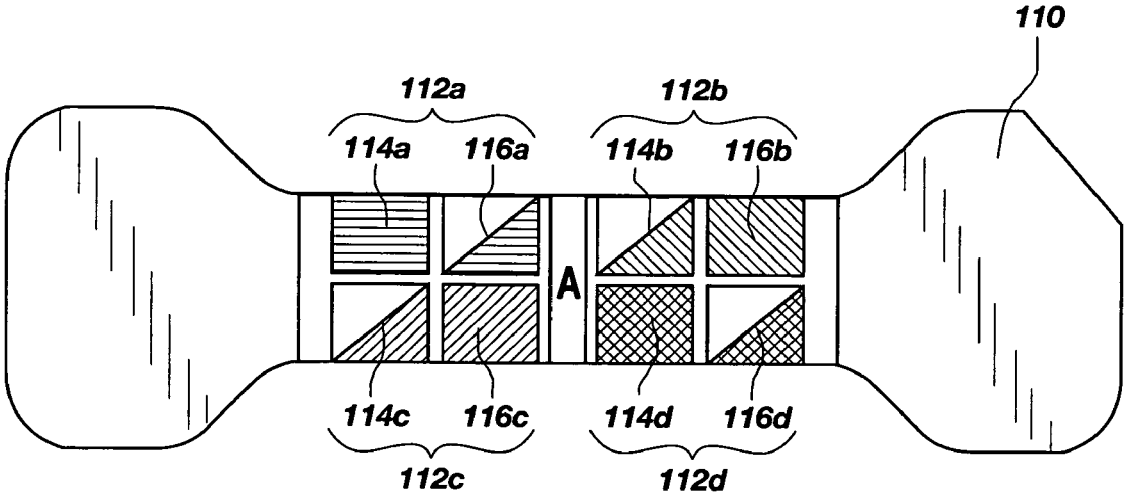
FIG. 3 is a top plan view of a lower label of the adhesive laminate label after removal of the upper label shown in FIGS. 1 and 2 that includes a second termination diagram that is different from the first termination diagram.

FIG. 3 is a top plan view of the lower label 110 after removal of the upper label 102. The lower label 110 includes a second plurality of color-coded symbol pairs 112*a*-112*d* arranged to represent the second termination diagram for terminating electrical conductors of a multi-conductor cable at electrical terminals of a modular communication connector jack. The second termination diagram is different than that of the first termination diagram of the upper label 102. For example, in the illustrated embodiment, the second termination diagram may be in accordance with the T568A wiring standard, and a symbol (e.g., the letter "A" in the illustrated embodiment) may be provided on the lower label 110 to represent that the second termination diagram is in accordance with the T568A wiring standard. It should be emphasized that the use of the T568A wiring standard is merely one example for the second termination diagram and other termination diagrams are contemplated. Prior to removal of the upper label 102, the second plurality of color-coded symbol pairs 112*a*-112*d* representing the second termination diagram are concealed by and not substantially visible through the upper label 102.

Still referring to FIG. 3, each symbol pair 112*a*-112*d* includes a corresponding color-coded symbol 114*a*-114*d* and a corresponding color-coded symbol 116*a*-116*d*. Again, the type of cross-hatching or lack thereof used to represent each color-coded symbol 114*a*-114*d* and 116*a*-116*d* represents the color. For example, in the T568A wiring standard, the color-coded symbols 114*a*-114*d* may be blue, white/green, white/brown, and orange, respectively, and the color-coded symbols 116*a*-116*d* may be white/blue, green, brown, and white/orange, respectively. As will be discussed in more detail with respect to FIGS. 4-11, each color-coded symbol pair 112*a*-112*d* may be color coded to correspond with a pair of signal lines of a multi-signal-line cable (e.g., electrical conductors of a multi-conductor cable) to be terminated at a modular communication connector jack on which the adhesive laminate label 100 is positioned.

The adhesive laminate label 100 allows an installer of a communication connector jack to select between multiple (e.g., at least two) different termination diagrams for terminating signal lines of a multi-signal-line cable, such as electrical conductors, at signal-line terminals of a modular communication connector jack. When the communication connector jack is to be terminated according to the first termination diagram on the upper label 102 of the adhesive laminate label 100, the installer can leave the upper label 102 in place adhered to and concealing the second termination diagram on the underlying lower label 110. When the communication connector jack is to be terminated according to the second termination diagram on the lower label 110 of the adhesive laminate label 100, the installer may manually peel the upper label 102 off of the underlying lower label 110 to expose the lower label 110 and the second termination diagram thereof.

It is noted that in the illustrated embodiment of the adhesive laminate label 100 shown in FIGS. 1-3, each of the color-coded symbols 106*a*-106*d*, 108*a*-108*d*, 114*a*-114*d*, and 116*a*-116*d* is given a particular color or combination of colors. However, in other embodiments of the invention, symbols besides color-coded symbols may be used. In another embodiment, individual letters may be used to represent a particular color. For example, the color-coded symbol 106*a* may be replaced with a letter "B" for blue or another suitable symbol.

Figure 4:
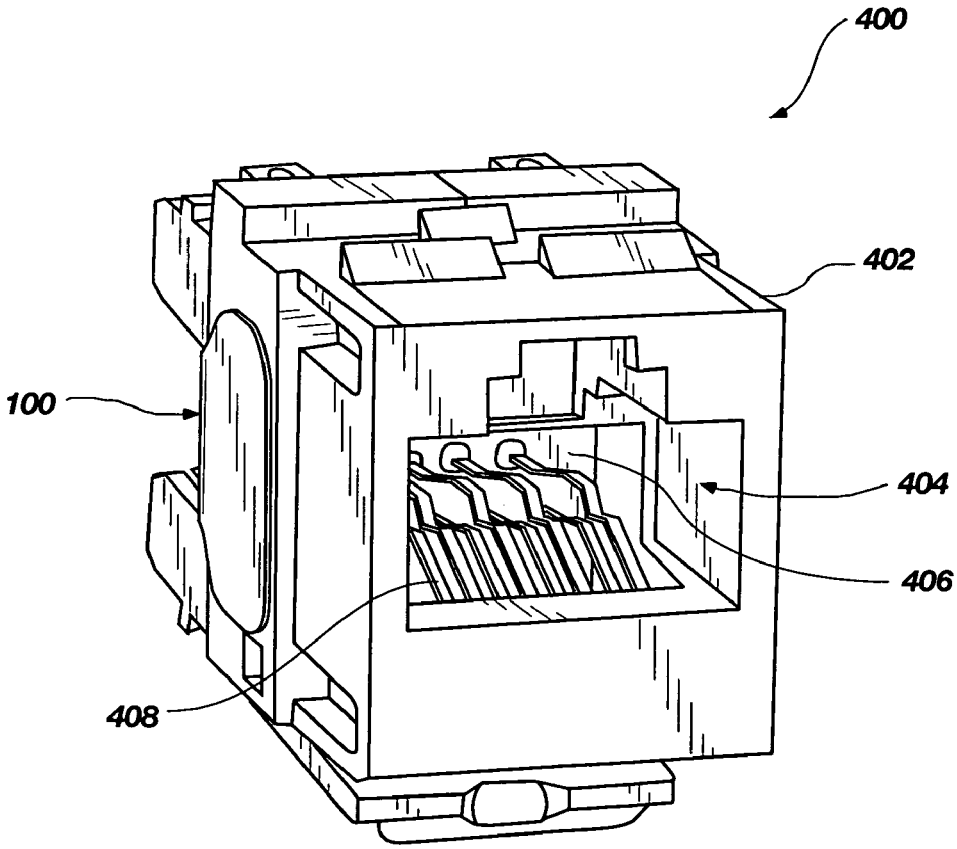
FIG. 4 is a front isometric view of a modular communication connector jack that includes the adhesive laminate label shown in FIG. 1 positioned thereon according to one embodiment of the invention.
Figure 5:
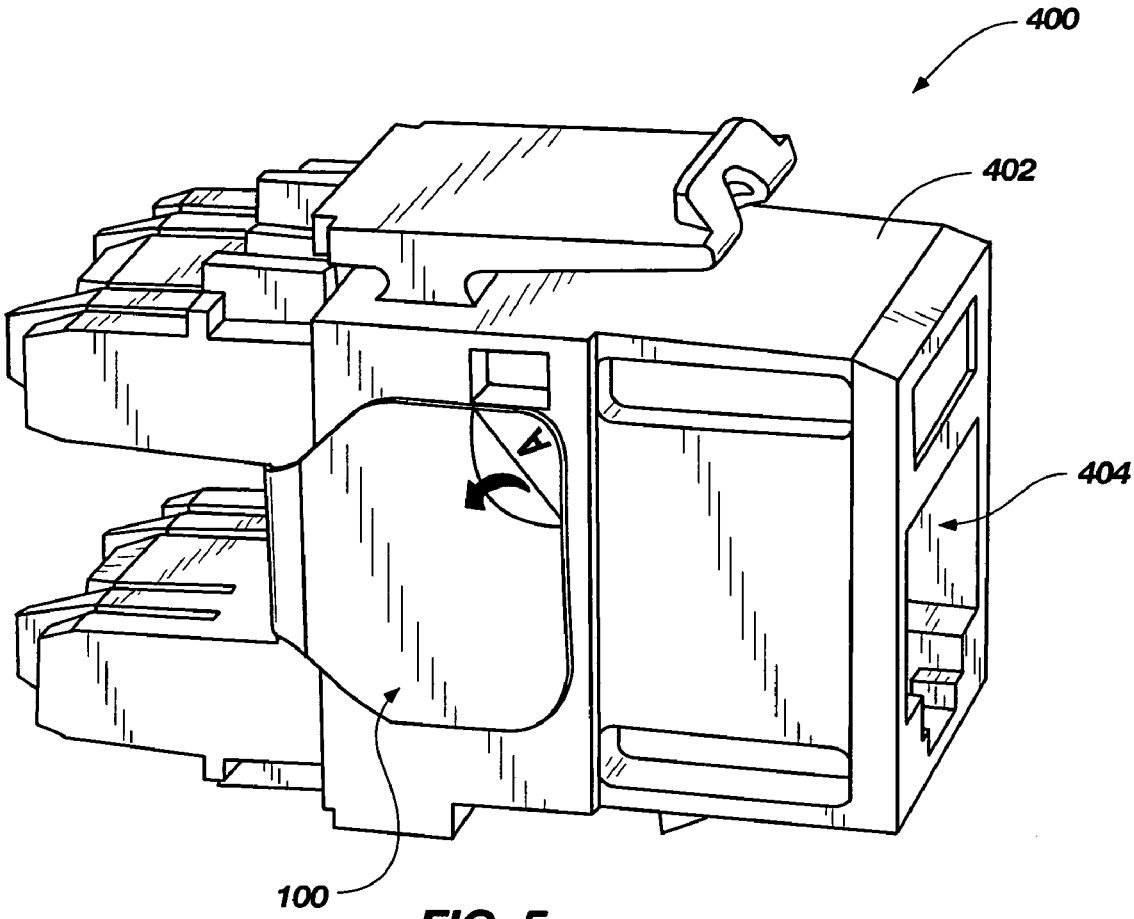
FIG. 5 is a side isometric view of the communication connector jack shown in FIG. 4.

The use of the adhesive laminate label 100 is better understood with reference to a modular communication connector jack 400 shown in FIGS. 4-10. FIGS. 4 and 5 are front and side isometric views, respectively, of the communication connector jack 400 having the adhesive laminate label 100 positioned thereon according to one embodiment of the invention. The illustrated communication connector jack 400 is a Category 6 RJ series electrical connector jack, which is also commonly referred to as an eight position electrical connector jack. However, the adhesive laminate label 100 may be used on a multitude of other types of communication connector jacks besides a Category 6 RJ series electrical connector jack, such as a six or a ten position electrical connector jack. The communication connector jack 400 includes a connector body 402 defining a recess 404 configured to receive a communication plug (not shown), such as a voice/data/video plug. The connector body 402 may also house a printed circuit board 406 or other circuitry, and further houses a plurality of electrical contact tines 408 that may be individually electrically coupled to the printed circuit board 406. Each electrical contact tine 408 projects forwardly from the printed circuit board 406 into the recess 404, and is configured to electrically connect with electrical contacts of the communication plug (not shown) inserted within the recess 404. For example, the communication plug may be a modular connector plug having a tab configured to releasably lock with the connector body 402 when inserted into the recess 404.

Figure 6:
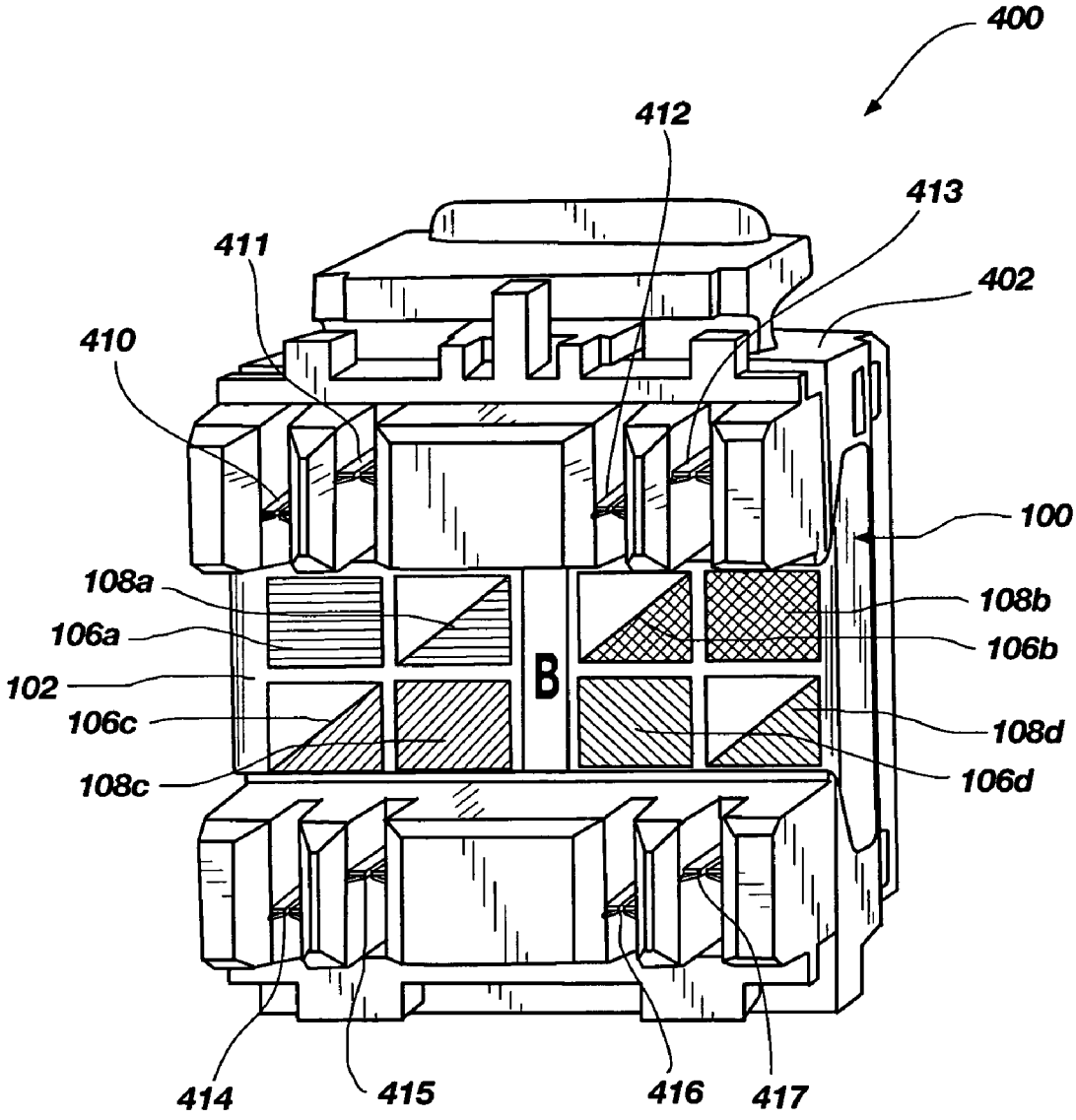
FIG. 6 is a back isometric view of the communication connector jack shown in FIG. 4 that shows the first termination diagram on the upper label of the adhesive laminate label.
Figure 7:
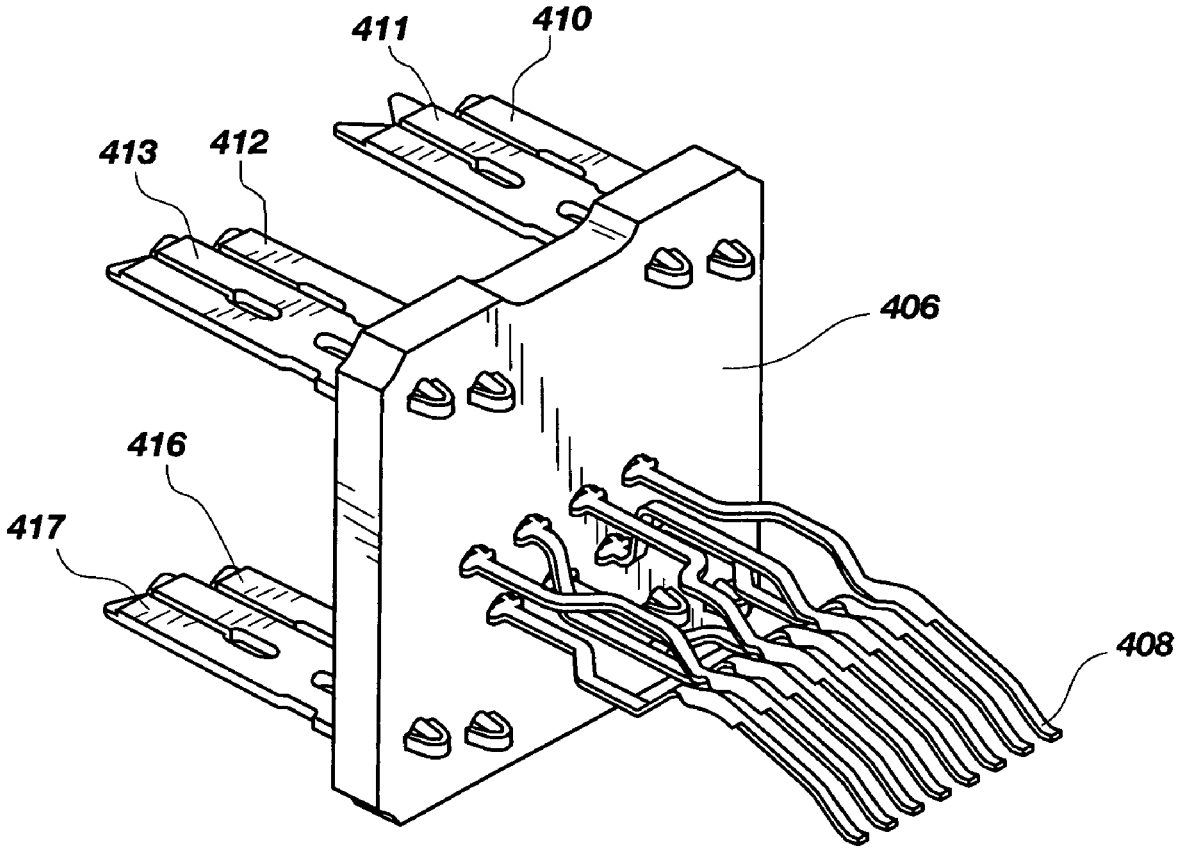
FIG. 7 is an isometric view of the communication connector jack shown in FIGS. 4-6 without the connector body that illustrates the printed circuit board and associated electrical contact tines and insulation displacement contacts.

FIG. 6 is a back isometric view of the communication connector jack 400, and more clearly shows the relationship of the first termination diagram on the upper label 102 of the adhesive laminate label 100 to a plurality of electrical terminals 410-417 (i.e., signal-line terminals) partially enclosed by the connector body 402. Referring to FIG. 7, each electrical terminal 410-417 is connected to and projects rearwardly from the printed circuit board 406. The electrical terminals 410-417 are each configured to be electrically coupled to a corresponding electrical conductor of a multi-conductor cable. Each electrical terminal 410-417 is electrically coupled to a corresponding one of the electrical contact tines 408 via circuitry formed in the printed circuit board 406. Although each electrical terminal 410-417 is shown configured as an insulation displacement contact, other types of electrical terminals may be used. During use, the electrical contact tines 408 carry data signals (e.g., voice, video, and/or data signals) to the communication plug inserted in the recess 404 from the multi-conductor cable connected to the electrical terminals 410-417 and vice versa. It is noted that in other embodiments of the invention, the printed circuit board 406 may be omitted, and each electrical contact tine 408 may be electrically coupled to a corresponding one of the electrical terminals 410-417 without an intervening printed circuit board 406.

Turning again to FIG. 6, the adhesive laminate label 100 may be positioned on a rear portion of the connector body 402 and recessed between the electrical terminals 410-413 and 414-417. The color-coded symbol pairs 104*a*-104*d* (not labeled) on the upper label 102 may be arranged in two rows so that the each color-coded symbol 106*a*-106*d* and 108*a*-108*d* is positioned proximate to a corresponding one of the electrical terminals 410-417 to indicate the type of color-coded electrical conductor of a pair of electrical conductors to terminate.

As can be appreciated from FIG. 6, the color-coded symbols 106*a*-106*d* and 108*a*-108*d* may be sufficiently large and easily readable by the installer that has to perform the tedious and repetitive task of terminating electrical conductors at the electrical terminals 410-417. For example, an installer may have to install several hundred communication connector jacks in a typical day during construction of a building. Often, installation of the communication connector jacks is performed in the dark or under other less than optimal light conditions.

Figure 8:
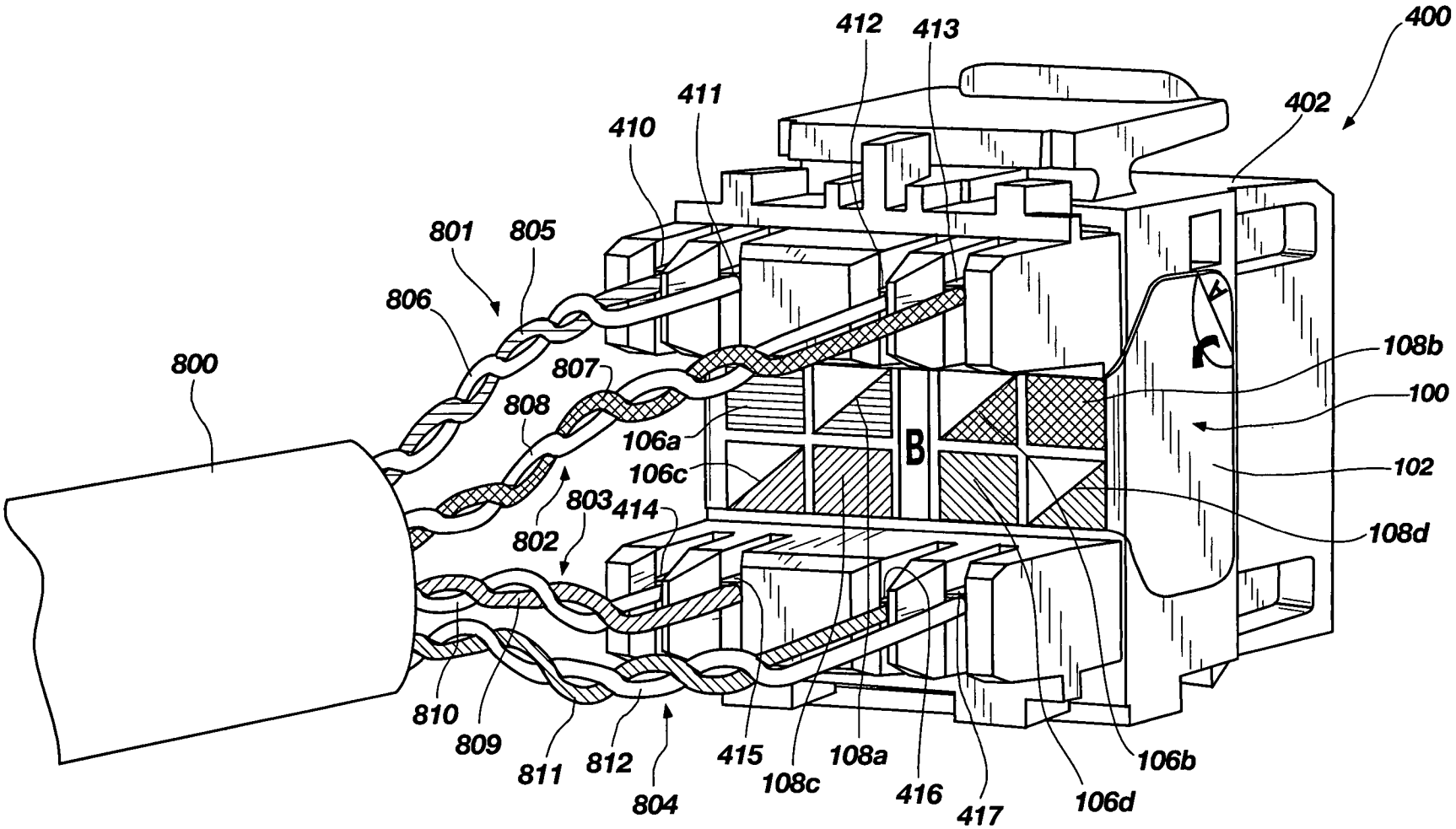
FIG. 8 is a back isometric view of the communication connector jack shown in FIG. 6 in which a multi-conductor cable is terminated according to the T568B standard.

FIG. 8 is a back isometric view of the communication connector jack 400 in which a multi-conductor cable 800 (e.g., a multi-signal-line cable) is terminated at the electrical terminals 410-417 according to the T568B standard of the first wiring pattern on the upper label 102. The multi-conductor cable 800 includes pairs of color-coded electrical conductors 801-804 (e.g., twisted pairs of color-coded electrical conductors). The pair of color-coded electrical conductors 801 is associated with the color-coded symbol pair 104*a* (not labeled), and includes an electrical conductor 805 having blue insulation and an electrical conductor 806 having white insulation. The electrical conductor 805 is terminated at the electrical terminal 410 proximate to the correspondingly color-coded symbol 106*a* and the electrical conductor 806 is terminated at the electrical terminal 411 proximate to the correspondingly color-coded symbol 108*a*. The pair of color-coded electrical conductors 802 is associated with the color-coded symbol pair 104*b* (not labeled), and includes an electrical conductor 807 having orange insulation and an electrical conductor 808 having white insulation. The electrical conductor 807 is terminated at the electrical terminal 413 proximate to the correspondingly color-coded symbol 108*b* and the electrical conductor 808 is terminated at the electrical terminal 412 proximate to the correspondingly color-coded symbol 106*b*.

Still referring to FIG. 8, the pair of color-coded electrical conductors 803 is associated with the color-coded symbol pair 104*c* (not labeled), and includes an electrical conductor 809 having brown insulation and an electrical conductor 810 having white insulation. The electrical conductor 809 is terminated at the electrical terminal 415 proximate to the correspondingly color-coded symbol 108*c* and the electrical conductor 810 is terminated at the electrical terminal 414 proximate to the correspondingly color-coded symbol 106*c*. The pair of color-coded electrical conductors 804 is associated with the color-coded symbol pair 104*d* (not labeled), and includes an electrical conductor 811 having green insulation and an electrical conductor 812 having white insulation. The electrical conductor 811 is terminated at the electrical terminal 416 proximate to the correspondingly color-coded symbol 106*d* and the electrical conductor 812 is terminated at the electrical terminal 417 proximate to the correspondingly color-coded symbol 108*d*.

Figure 9:
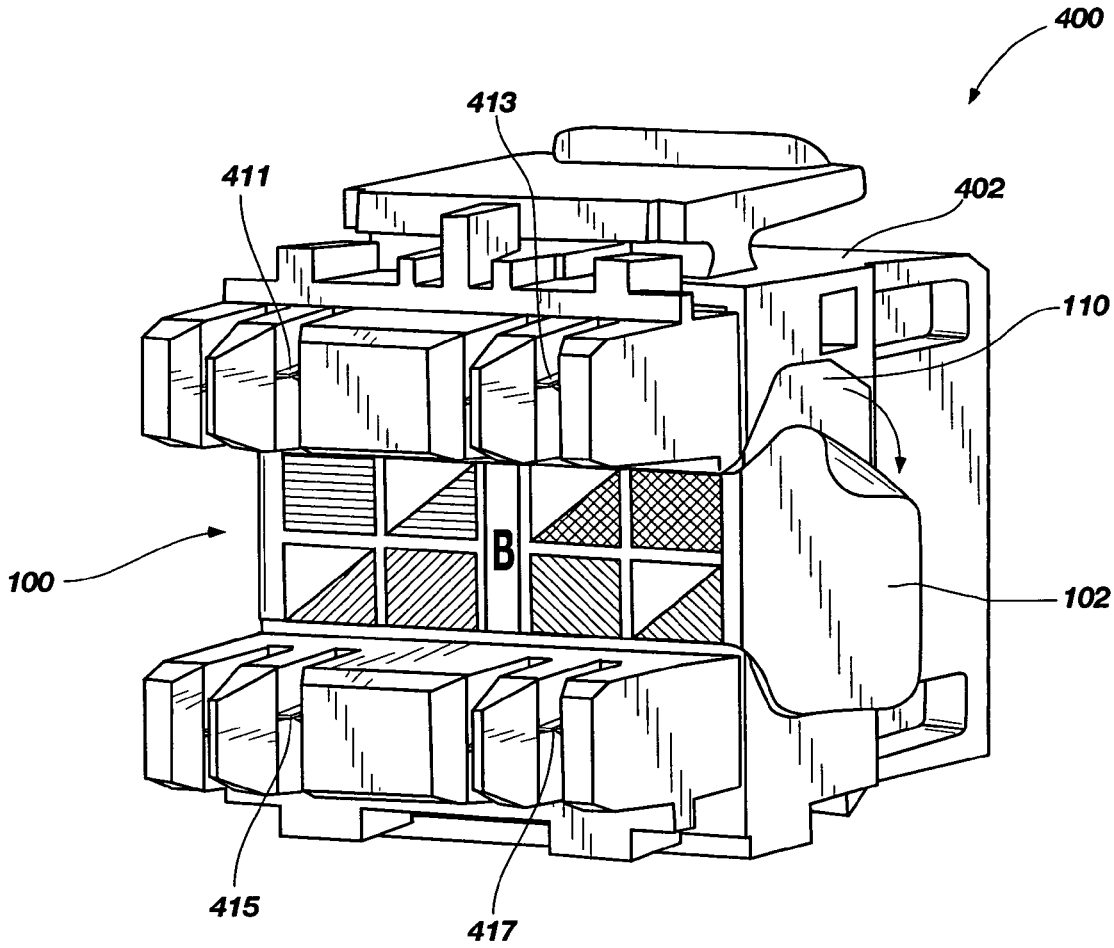
FIG. 9 is a back isometric view of the communication connector jack shown in FIG. 6, with the upper label of the adhesive laminate label being removed from the underlying lower label.
Figure 10:
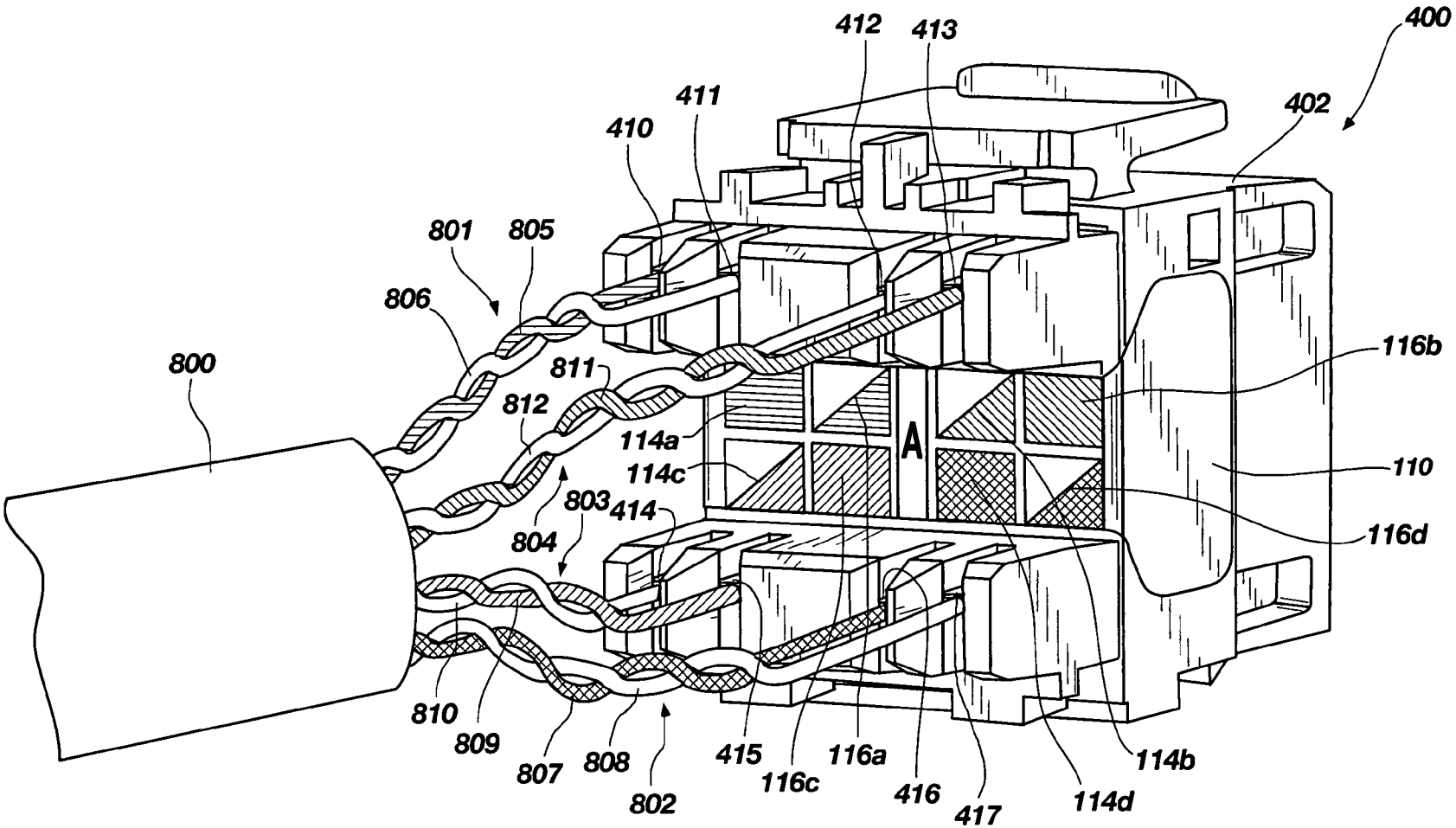
FIG. 10 is a back isometric view of the communication connector jack with the lower label of the adhesive laminate label revealed after removal of the upper label, and a multi-conductor cable terminated according to the T568A wiring standard on the lower label.

Referring to FIG. 9, when the multi-conductor cable 800 is to be terminated according to the second termination diagram on the underlying lower label 110, an installer may remove the upper label 102 of the adhesive laminate label 100 from the underlying lower label 110. FIG. 10 is a back isometric view of the communication connector jack 400 with the lower label 110 of the adhesive laminate label 100 revealed after removal of the upper label 102. As shown in FIG. 10, the color-coded electrical conductors 805-812 of corresponding pairs of color-coded electrical conductors 801-804 may be terminated in accordance with the second termination diagram shown on the lower label 110 that, in the illustrated embodiment, is in accordance with the T568A wiring standard.

Although FIGS. 4-10 illustrates a specific type of configuration for the communication connector jack 400, many other different types of communication connector jack configurations may be employed in combination with the adhesive laminate label 100. For example, in other embodiments of the invention, a connector body of a modular communication connector jack may not have sufficient space between insulation displacement contacts for the adhesive laminate label 100. In such embodiments, the adhesive laminate label 100 may be positioned on a side portion of the connector body, while still providing a termination diagram that an installer can terminate electrical conductors or other types of signal lines at the signal-line terminals. For example, the adhesive laminate label 100 may not be positioned between the signal-line terminals. Thus, as desired or needed, the adhesive laminate label 100 may be positioned on any suitable location of a connector body of a communication connector jack. Moreover, in other embodiments of the invention, electrical terminals or other signal-line terminals of a communication connector jack may be arranged generally in a single row or staggered, as opposed to two rows.

The teachings disclosed herein may also be employed with other signal lines besides electrical conductors. For example, in an optical communication connector jack, optical fibers may be terminated according to a termination diagram on a label of an adhesive laminate label at signal-line terminals. In such an embodiment, each optical fiber is terminated at a corresponding ferrule (i.e., a signal-line terminal) housed by a connector body and the connector body is configured to receive or otherwise interface with an optical communication plug.

The principals of the embodiments disclosed herein are also applicable to patch panels including multiple communication connector jacks, face plates, ceiling enclosures, floor boxes, and many other different applications of the disclosed adhesive laminate labels and communication connector jacks.

While various aspects and embodiments of the invention have been disclosed herein, other aspects and embodiments will be apparent to those skilled in the art. The various aspects and embodiments disclosed herein are for purposes of illustration and are not intended to be limiting.

The invention claimed is:

1. An adhesive laminate label for a communication connector jack, comprising:

an upper label including a first termination diagram; and a lower label including a second termination diagram that is different than that of the first termination diagram, at least the second termination diagram of the lower label being covered by the upper label, and the upper label being removably adhered to the lower label.

2. The adhesive laminate label of claim 1 wherein:

the first termination diagram comprises a first plurality of color-coded symbol pairs each of which is associated with a pair of correspondingly color-coded signal lines, the first plurality of color-coded symbol pairs arranged to represent the first termination diagram; and the second termination diagram comprises a second plurality of color-coded symbol pairs each of which is associated with one of the pairs of correspondingly color-coded signal lines, the second plurality of color-coded symbol pairs arranged to represent the second termination diagram.

3. The adhesive laminate label of claim 2 wherein:

the first plurality of color-coded symbol pairs are arranged in two rows each of which includes two of the first plurality of color-coded symbol pairs; and the second plurality of color-coded symbol pairs are arranged in two rows each of which includes two of the second plurality of color-coded symbol pairs.

4. The adhesive laminate label of claim 1 wherein:

the first termination diagram is in accordance with a first wiring standard; and the second termination diagram is in accordance with a second wiring standard.

5. The adhesive laminate label of claim 1 wherein the lower and upper labels are configured to fit between first and second rows of insulation displacement contacts of the communication connector jack.

6. The adhesive laminate label of claim 1 wherein the second termination diagram of the lower label is concealed by the upper label.

7. The adhesive laminate label of claim 1 wherein the upper label comprises a marking thereon that indicates the presence of the second termination diagram on the lower label.

8. A communication connector jack, comprising:

a connector body including a recess configured to receive a communication plug;

a plurality of signal-line terminals associated with the connector body; and an adhesive laminate label positioned on the connector body and including:

an upper label including a first termination diagram for terminating signal lines at the plurality of signal-line terminals; and a lower label including a second termination diagram for terminating the signal-lines at the plurality of signal-line terminals, the second termination diagram being different than that of the first termination diagram, at least the second termination diagram of the lower label being covered by the upper label, and the lower label being removably adhered to the upper label.

9. The communication connector jack of claim 8 wherein:

the plurality of signal-line terminals are arranged in first and second rows; and the adhesive laminate label is positioned between the first and second rows of signal-line terminals.

10. The communication connector jack of claim 9 wherein:

the first termination diagram comprises a plurality of symbols each of which is positioned proximate to a corresponding one of the signal-line terminals; and the second termination diagram comprises a plurality of symbols each symbol of which is positioned proximate to a corresponding one of the signal-line terminals.

11. The communication connector jack of claim 8 wherein:

the first termination diagram comprises a plurality of symbols each of which is positioned proximate to a corresponding one of the signal-line terminals; and the second termination diagram comprises a plurality of symbols each symbol of which is positioned proximate to a corresponding one of the signal-line terminals.

12. The communication connector jack of claim 8 wherein:

the first termination diagram comprises a first plurality of color-coded symbol pairs each of which is associated with a pair of correspondingly color-coded signal lines to be terminated at a pair of the signal-line terminals, the first plurality of color-coded symbol pairs arranged to represent the first termination diagram; and the second termination diagram comprises a second plurality of color-coded symbol pairs each of which is associated with one of the pairs of correspondingly color-coded signal lines to be terminated at one of the pairs of the signal-line terminals, the second plurality of color-coded symbol pairs arranged to represent the second termination diagram.

13. The communication connector jack of claim 12 wherein:

the first plurality of color-coded symbol pairs are arranged in two rows each of which includes two of the first plurality of color-coded symbol pairs; and the second plurality of color-coded symbol pairs are arranged in two rows each of which includes two of the second plurality of color-coded symbol pairs.

14. The communication connector jack of claim 8 wherein:

the first termination diagram is in accordance with a first wiring standard; and the second termination diagram is in accordance with a second wiring standard.

15. The communication connector jack of claim 8 wherein the second termination diagram of the lower label is concealed by the upper label.

16. The communication connector jack of claim 8 wherein the adhesive laminate label is not positioned between the signal-line terminals.

17. The communication connector jack of claim 8 wherein each of the signal-line terminals comprises an insulation displacement contact.

18. The communication connector jack of claim 8, further comprising:

a plurality of electrical contact tines extending within the recess; and wherein each of the signal-line terminals comprises an electrical terminal that is coupled to a corresponding one of the electrical contact tines.

19. The communication connector jack of claim 18, further comprising a printed circuit board housed by the connector body, and electrically coupled to the plurality of electrical contact tines and the electrical terminals.

20. The communication connector jack of claim 8 wherein the upper label of the adhesive laminate label comprises a marking thereon that indicates the presence of the second termination diagram on the lower label.

21. A method, comprising:

selectively displaying only one termination diagram of at least two termination diagrams of an adhesive laminate label positioned on a communication connector jack; and terminating a plurality of signal lines at corresponding signal-line terminals in accordance with the selectively displayed termination diagram.

22. The method of claim 21 wherein:

selectively displaying only one termination diagram of at least two termination diagrams of an adhesive laminate label positioned on a communication connector jack comprises peeling an upper label having a first termination diagram off of an underlying lower label having a second termination diagram that is different than that of the first termination diagram; and terminating a plurality of signal lines at corresponding signal-line terminals in accordance with the selectively displayed termination diagram comprises terminating each of the signal lines at a corresponding one of the signal-line terminals in accordance with the second termination diagram.

23. The method of claim 22 wherein terminating each of the signal lines at a corresponding one of the signal-line terminals in accordance with the second termination diagram comprises terminating each of the signal-lines at a corresponding one of the signal-line terminals located proximate to a correspondingly color-coded symbol of the second termination diagram.

24. The method of claim 21 wherein:

selectively displaying only one termination diagram of at least two termination diagrams of an adhesive laminate label positioned on a communication connector jack comprises leaving an upper label having a first termination diagram at least partially covering an underlying lower label having a second termination diagram that is different than that of the first termination diagram; and terminating a plurality of signal lines at corresponding signal-line terminals in accordance with the selectively displayed termination diagram comprises terminating each of the signal lines at a corresponding one of the signal-line terminals in accordance with the first termination diagram.

25. The method of claim 24 wherein terminating each of the signal lines at a corresponding one of the signal-line terminals in accordance with the first termination diagram comprises terminating each of the signal-lines at a corresponding one of the signal-line terminals located proximate to a correspondingly color-coded symbol of the first termination diagram.

* * * * *